US008877290B2

(12) United States Patent
Uyama

(10) Patent No.: US 8,877,290 B2
(45) Date of Patent: Nov. 4, 2014

(54) METHOD FOR PRODUCING LIQUID-EJECTION HEAD

(71) Applicant: Canon Kabushiki Kaisha, Tokyo (JP)

(72) Inventor: Masaya Uyama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/041,027

(22) Filed: Sep. 30, 2013

(65) Prior Publication Data

US 2014/0093646 A1 Apr. 3, 2014

(30) Foreign Application Priority Data

Oct. 2, 2012 (JP) ..... 2012-220367

(51) Int. Cl.

| | |
|---|---|
| ***B44C 1/22*** | (2006.01) |
| ***B41J 2/04*** | (2006.01) |
| ***B41J 2/16*** | (2006.01) |
| ***B41J 2/00*** | (2006.01) |
| ***B05D 3/00*** | (2006.01) |
| *B41J 2/14* | (2006.01) |

(52) U.S. Cl.

CPC ..... *B05D 3/002* (2013.01); *B41J 2/1628* (2013.01); *B41J 2002/14467* (2013.01); *B41J 2/1642* (2013.01); *B41J 2/1603* (2013.01); *B41J 2/1639* (2013.01); *B41J 2/1629* (2013.01); *B41J 2/00* (2013.01); *B41J 2/1631* (2013.01); *B41J 2/1645* (2013.01); *B41J 2/1646* (2013.01)

USPC ..... 427/248.1; 216/27; 264/338; 347/65

(58) Field of Classification Search

CPC ..... B44C 1/22; B41J 2/04; B41J 2/16

USPC ..... 427/248.1; 216/27; 264/338; 347/65; 438/21

See application file for complete search history.

(56) References Cited

U.S. PATENT DOCUMENTS

| | | | | |
|---|---|---|---|---|
| 6,582,060 | B1 * | 6/2003 | Kitakami et al. | 347/56 |
| 7,600,856 | B2 | 10/2009 | Lebens et al. | |
| 2004/0130600 | A1 * | 7/2004 | Miyamoto et al. | 347/64 |
| 2005/0275695 | A1 * | 12/2005 | Murata | 347/70 |
| 2007/0139488 | A1 * | 6/2007 | Fujishiro | 347/72 |
| 2007/0165078 | A1 * | 7/2007 | Hashimoto | 347/65 |
| 2008/0076197 | A1 * | 3/2008 | Komuro et al. | 438/21 |
| 2008/0217290 | A1 * | 9/2008 | Yokouchi | 216/27 |
| 2008/0291244 | A1 * | 11/2008 | Koizumi et al. | 347/44 |
| 2009/0065474 | A1 * | 3/2009 | Chida et al. | 216/27 |
| 2009/0246537 | A1 * | 10/2009 | Matsuo | 428/441 |
| 2011/0221822 | A1 * | 9/2011 | Hagiwara et al. | 347/44 |

FOREIGN PATENT DOCUMENTS

EP 1078758 A2 * 2/2001

* cited by examiner

*Primary Examiner* — Bret Chen

(74) *Attorney, Agent, or Firm* — Canon USA Inc IP Division

(57) ABSTRACT

A method for producing a liquid-ejection head includes forming molds on or above the substrate, the molds being used as mold members for forming the plurality of liquid chambers; forming the flow-passage-forming member by depositing an inorganic material on or above the substrate and the molds by chemical vapor deposition, the flow-passage-forming member having depressed portions each formed in an area between an adjacent pair of the liquid-chamber side walls in which the molds are not formed; forming a water-repellent layer on the orifice plate; forming filling members in the depressed portions by applying a filling material to the flow-passage-forming member having the water-repellent layer formed thereon to fill the depressed portions with the filling material; forming the ejection ports in the flow-passage-forming member; and removing the molds after forming the ejection ports.

14 Claims, 4 Drawing Sheets

METHOD FOR PRODUCING LIQUID-EJECTION HEAD

BACKGROUND OF THE INVENTION

1. Field of the Invention

The present disclosure relates to a method for producing a liquid-ejection head.

2. Description of the Related Art

U.S. Pat. No. 7,600,856 discloses an example of the related art that provides a liquid-ejection head including an orifice plate composed of an inorganic material. In this example, mold members are formed in areas in which liquid chambers, such as liquid-ejection chambers, are to be formed, and subsequently an inorganic material is deposited on the mold members by chemical vapor deposition (CVD) so as to cover the mold members, thereby forming an orifice plate and liquid-ejection chamber walls.

SUMMARY OF THE INVENTION

Provided herein is a method for producing a liquid-ejection head including:

a substrate on or above which a plurality of actuators are formed, the plurality of actuators generating energy for ejecting a liquid; and a flow-passage-forming member on or above the substrate, the flow-passage-forming member defining ejection ports through which the liquid is ejected and a plurality of liquid chambers each having a corresponding one of the plurality of actuators, the flow-passage-forming member including an orifice plate defining the ejection ports and liquid-chamber side walls defining side walls of the plurality of liquid chambers, the method including the steps of:

(1) forming molds on or above the substrate, the molds being used as mold members for forming the plurality of liquid chambers;

(2) forming the flow-passage-forming member by depositing an inorganic material on or above the substrate and the molds by chemical vapor deposition, the flow-passage-forming member having depressed portions each formed in an area between an adjacent pair of the liquid-chamber side walls in which the molds are not formed;

(3) forming a water-repellent layer on the orifice plate;

(4) forming filling members in the depressed portions by applying a filling material to the flow-passage-forming member having the water-repellent layer formed thereon to fill the depressed portions with the filling material;

(5) forming the ejection ports in the flow-passage-forming member; and (6) removing the molds after forming the ejection ports.

Further features of the present invention will become apparent from the following description of exemplary embodiments with reference to the attached drawings.

DESCRIPTION OF THE EMBODIMENTS

When an orifice plate and liquid-ejection chamber walls are formed by depositing an inorganic material on mold members by CVD so as to cover the mold members as described in U.S. Pat. No. 7,600,856, a film is formed relatively tightly along the mold members due to the nature of CVD, and consequently three-dimensional protrusions and depressions formed using the mold members are directly transferred to the film. As a result, depressed portions depressed toward the orifice plate are disadvantageously formed on the orifice plate. In particular, depressed portions formed between the walls partitioning adjacent liquid-ejection chambers from each other are formed in areas adjoining the ejection ports.

Fine liquid particles generated due to liquid ejection may accumulate in the depressed portions, thereby forming liquid pools in the depressed portions. The liquid pool gradually grows larger and may reach the vicinity of the ejection port through which a liquid is ejected. As a result, when being ejected, flying liquid particles may be come into contact with the liquid pool, which may alter the ejection direction, and consequently printing quality may be degraded. When the liquid pool is removed by cleaning the surface of the orifice plate by wiping or the like in order to prevent the ejection direction from being altered, it is difficult to remove the liquid pool because the wiping blade does not efficiently come into contact with the depressed portion.

A widely used technique for filling the depressed portions is a method in which a hole-filling material is applied to depressed portions to fill the depressed portions therewith and then the surface of the hole-filling material is planarized by polishing by, for example, chemical mechanical polishing (CMP).

However, CMP requires a long polishing time and huge equipment investment, and thus the production cost increases.

Accordingly, the present disclosure provides a method for producing a liquid-ejection head with which depressed portions formed in a flow-passage-forming member may be efficiently filled when the flow-passage-forming member is formed by depositing an inorganic material by CVD.

The present disclosure may also provide a method for easily producing a liquid-ejection head including a flow-passage-forming member formed by depositing an inorganic material by CVD with which depressed portions may be efficiency filled, formation of liquid pools may be suppressed, and degradation of printing quality may be suppressed.

Hereafter, the embodiment of the present invention is described in detail with reference to the attached drawings. The embodiment described below does not limit the scope of the present invention and is intended to provide those who are skilled in the art with sufficient explanation of the present invention.

Figure 1A:
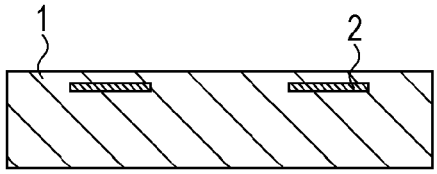
FIGS. 1A to 1G are schematic cross-sectional views for explaining the steps of a method for producing a liquid-ejection head.
Figure 1B:
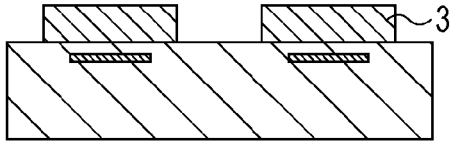
Figure 1C:
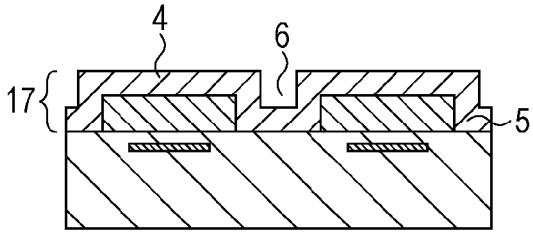
Figure 1D:
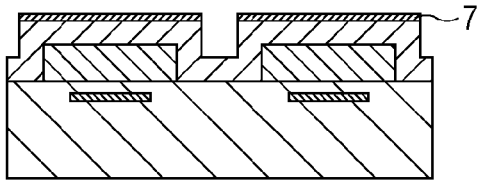
Figure 1E:
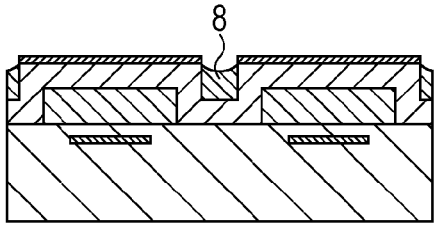
Figure 1F:
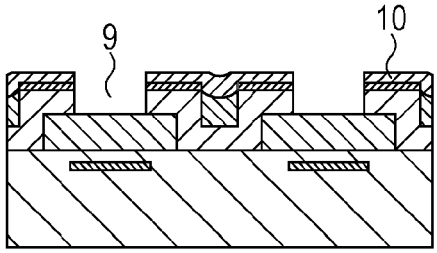
Figure 1G:
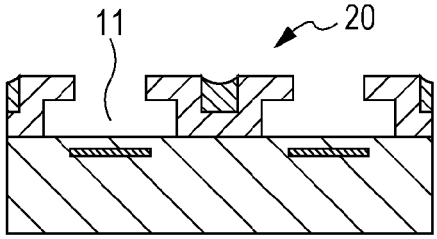
Figure 2:
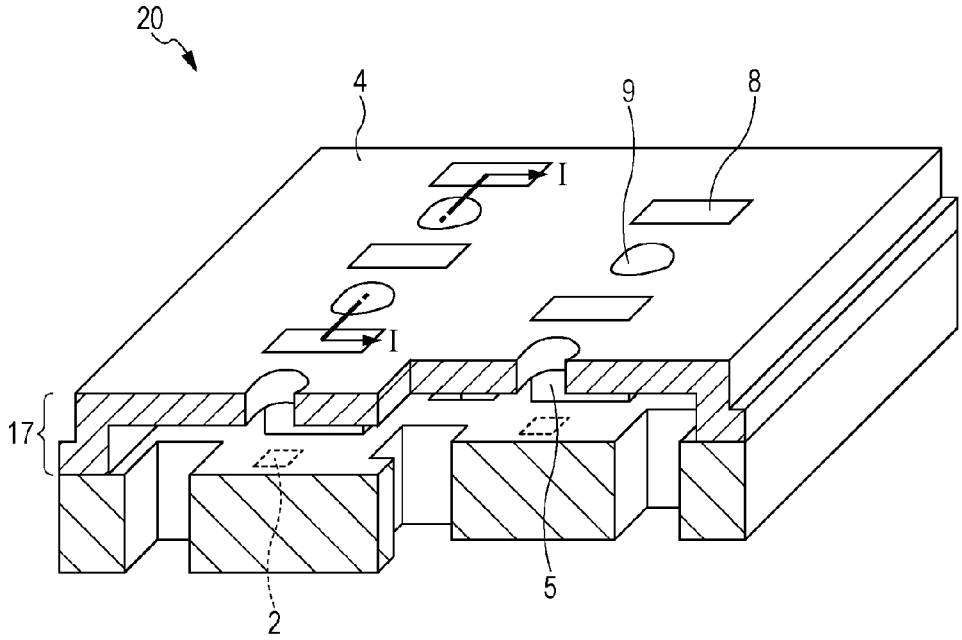
FIG. 2 is a schematic perspective view illustrating an example of a liquid-ejection head.

FIG. 2 is a perspective view illustrating a liquid-ejection head 20 produced according to this embodiment. FIGS. 1A to 1G are schematic cross-sectional views for explaining the steps of the method for producing a liquid-ejection head, which are taken along line I-I in FIG. 2 and viewed in a direction perpendicular to the cross-section. Now, steps of the producing method according to this embodiment are described in order with reference to FIGS. 1A to 1G.

As shown in FIG. 1A, a liquid-ejection-head substrate 1 (hereafter, also referred to as simply "substrate") is prepared.

The substrate 1 includes a plurality of actuators 2 (also called as "ejection-energy-generating elements") that generate energy used for ejecting a liquid, such as ink.

The substrate 1 may be a single-crystal silicon substrate, on which a driving circuit and wiring lines connecting the drive circuit to the actuators can be easily arranged.

An example of the actuator 2 is heater-type actuators that generate heat by conducting electricity through a resistor. Another example of the actuator 2 is an element that converts electric energy into ejection energy.

As shown in FIG. 1B, molds 3 are formed on or above the substrate. The molds 3 serve as mold members used for forming a liquid chamber and are removable in the post-process.

The molds 3 serve as mold members for forming internal spaces of the flow-passage-forming member, which include, in addition to the liquid chambers, for example, liquid-flow passages that connect liquid-supply ports to the liquid chambers.

The material of the mold is selected while considering the material of the peripheral members. In this embodiment, an organic resin material or a metal material may be selected since the flow-passage-forming member defining the orifice plate and the liquid-chamber side walls is composed of an inorganic material. An example of the organic resin material is a polyimide resin with consideration of heat resistance. Examples of the metal material include aluminium and an aluminium alloy with consideration of removability.

When the mold material is an organic resin material, the mold material can be deposited by a common coating method, such as spin-coating. When the mold material is a photosensitive material, the mold material can be patterned through an exposure-development treatment. When the mold material is a non-photosensitive material, the mold material can be patterned by reactive ion etching (RIE) using an oxygen-based gas with a mask formed of photoresist or the like on the mold material.

When the mold material is a metal material, the mold material can be deposited by physical vapor deposition (PVD), such as sputtering. A metal material can be patterned by RIE using a gas corresponding to the selected metal material with a mask formed of photoresist on the metal material. When the metal material is aluminium, a chlorine etching gas may be used.

As shown in FIG. 1C, an inorganic material is deposited on or above the substrate 1 and the molds 3 by chemical vapor deposition (CVD) to form a flow-passage-forming member 17. The flow-passage-forming member 17 includes an orifice plate 4 defining upper walls of the liquid chambers in which ejection ports are to be formed and liquid-chamber side walls 5 defining side surfaces of the liquid chambers. In this embodiment, the orifice plate 4 and the liquid-chamber side walls 5 are composed of an inorganic material. The flow-passage-forming member 17 has depressed portions 6 each formed in a depressed portion formed between two adjacent liquid-chamber side walls 5, on or above which the mold 3 is not deposited. In other words, the flow-passage-forming member 17 has depressed portions formed between two opposing liquid-chamber side walls located between two adjacent liquid chambers.

In this embodiment, the flow-passage-forming member includes the orifice plate 4 defining the ejection ports and the liquid-chamber side walls 5 defining the side walls of the liquid chambers. The orifice plate 4 and the liquid-chamber side walls 5 may be formed of the same inorganic material as each other at a time.

An example of the inorganic material is, but not limited to, a silicon compound prepared from silicon and at least one substance selected from oxygen, nitrogen, and carbon. Specific examples of the silicon compound include a silicon oxide, a silicon nitride, a silicon carbide, and a silicon oxynitride. The inorganic material may be deposited by, for example, plasma enhanced CVD (PECVD).

Since CVD is a conformal deposition method, a stepped portion is created between an area on which the mold is formed and an area on which the mold is not formed. Thus, the depressed portions 6 are formed.

As shown in FIG. 1D, a water-repellent layer 7 is formed on the surface (upper surface) of the flow-passage-forming member, in which the ejection ports are to be formed. In other word, the water-repellent layer 7 is formed only on the surface of the orifice plate 4.

The water-repellent layer may be formed by, for example, diluting a fluorocarbon compound, which is the material of the water-repellent layer, with a solvent to prepare a water-repellent material and depositing the water-repellent material only on the protruding surface of the orifice plate in the manner of relief printing and drying the deposited water-repellent material.

As shown in FIG. 1E, a filling material is applied to the flow-passage-forming member to fill the depressed portions 6 with filling members 8. In other words, the filling material is applied over the entire surface of the substrate including the depressed portions 6 and as a result the filling members 8 are formed in the depressed portions 6.

The filling material may be in the form of a liquid. The filling material, after being deposited in the depressed portions 6, becomes solidified to form the filling members 8.

The filling material may be applied by, for example, spin coating. A liquid filling-material may be applied by spin-coating. The filling material flows into the depressed portions 6 due to the effect of the water-repellent layer formed on the orifice plate.

Any filling material may be employed as long as it can be used in the form of a liquid. Examples of such filling material include spin-on glass (SOG) and a resist material containing a resin and the like. In the case of a liquid-ejection method in which a liquid is ejected using a heater, the filling material may be SOG. SOG allows the damage in the orifice plate and the interface peeling between the filling member and the liquid-chamber side wall, which are caused by thermal shock such as due to heat cycle due to ejection, to be suppressed because the difference in thermal expansion coefficient between SOG and a silicon compound, which is the material of the orifice plate, is small.

Figure 3A:
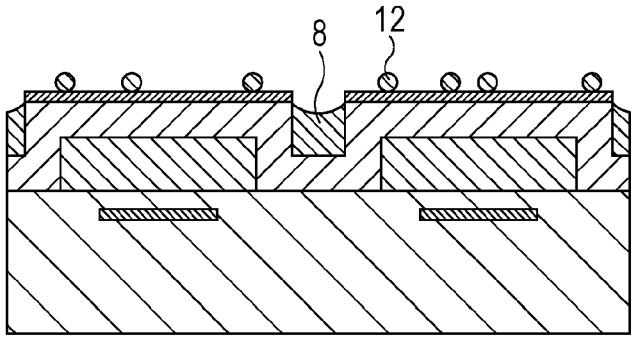
FIGS. 3A and 3B are schematic cross-sectional views illustrating an example of a method for producing a liquid-ejection head.
Figure 3B:
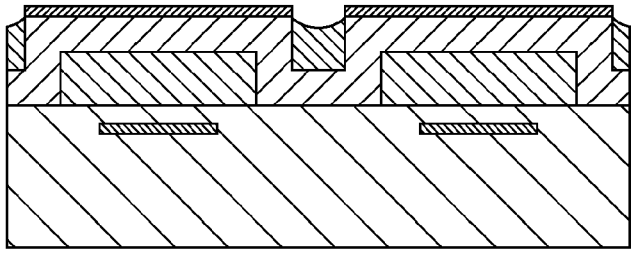

The filling material may be an organic SOG that contains a methylsiloxane polymer as a main component. While the filling material flows into the depressed portion due to the effect of the water-repellent layer, as shown in FIG. 3A, a portion of the filling material (residue 12) may remain on the orifice plate on which the water-repellent layer is formed. The residue 12 composed of the organic SOE, which slightly remains on the water-repellent layer 7, can be easily removed by chemical dry etching (CDE) using an oxygen-based gas as shown in FIG. 3B because the organic SOG is susceptible to oxygen plasma. In this case, the residue 12 has a substantially spherical shape due to the effect of a water-repellent film, and consequently the surface area per volume of the residue 12 increases, which results in an increase in the area to be etched. Therefore, etching proceeds faster in the residue 12 than in the filling member 8 deposited in the depressed portion. As a result, the residue 12 can be removed without etching the filling member 8 to a great degree. Note that, the thickness of the water-repellent layer 7 may be reduced because the water-repellent layer 7 is relatively susceptible to CDE using an oxygen-based gas.

In order to fill the depressed portion 6 with the filling material more efficiently using the effect of the water-repellent layer, the surface tension of the filling material may be increased. When the surface tension is increased, the water-repellent layer sheds the filling material more easily. As a result, little filling material remains on the water-repellent layer 7, and consequently the depressed portion 6, in which the water-repellent layer 7 is not formed, is easily filled with the filling material. The surface tension of the filling material can be increased by adding water, ethylene glycol, or glycerin to the filling material. Thus, in this embodiment, the filling material may contain at least one solvent component selected from water, ethylene glycol, and glycerin. When the filling material is SOG, it can be dissolved in the added water, ethylene glycol, or glycerin by stirring thoroughly because SOG generally contains an alcohol solvent, such as isopropyl alcohol or ethanol.

As shown in FIG. 1F, ejection ports 9 that eject a liquid are formed.

The ejection ports may be formed by, for example, by RIE using a fluorine-based gas with a mask 10 formed of photoresist. Generally, the photoresist is applied to a wafer by spin-coating in the form of a liquid and then baked. When a liquid photoresist is applied to a substrate having depressed portions on the surface to be applied, the thickness of the photoresist mask may be large in order to sufficiently cover the stepped portions, that is, the depressed portions. However, the increased thickness of the photoresist mask may cause the cross-sectional profile of the photoresist mask patterned due to exposure to be degraded, which results in a reduction in etching accuracy. When the depressed portions are filled with the filling members as in this embodiment, the stepped portions are not formed even when the thickness of the photoresist mask is small. As a result, the accuracy of patterning due to exposure is enhanced, and thus the accuracy of finishing the ejection ports is enhanced.

As shown in FIG. 1G, liquid chambers 11 are formed by removing the molds. Thus, a liquid-ejection head 20 is produced.

The molds may be removed by, for example, isotropic etching. When the mold material is an organic resin material, the molds can be removed by CDE using an oxygen-based gas. Simultaneously, the water-repellent layer can be removed. When the mold material is a metal material, the molds can be removed by wet etching using a chemical solution that dissolves the selected metal material. When the metal material is, for example, aluminium, a phosphoric-acid-based etchant may be used. Then, the water-repellent layer can be removed by CDE using an oxygen-based gas. When the water-repellent layer is purposely left, this CDE treatment is not necessarily be performed (not shown).

Through the steps described above, the degradation of printing quality due to liquid pools may be suppressed when a liquid-ejection head includes an orifice plate composed of an inorganic material.

Figure 4A:
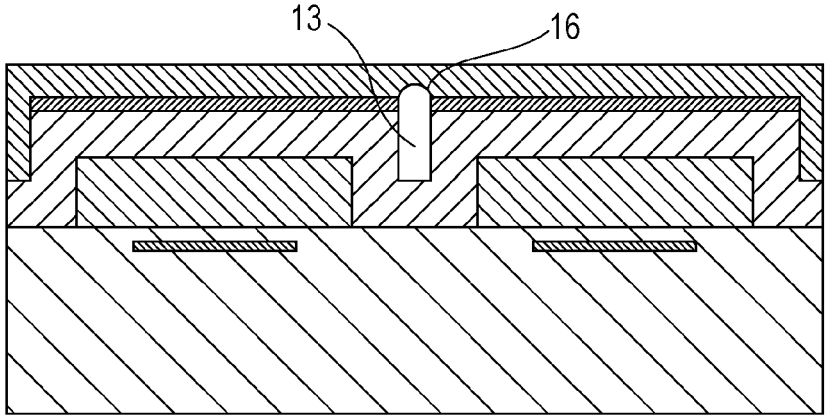
FIGS. 4A to 4C are schematic cross-sectional views illustrating an example of a method for producing a liquid-ejection head.

In the step shown in FIG. 1E, where the depressed portions are filled with the filling members using the water-repellent layer, when the width of the depressed portion is small, as shown in FIG. 4A, an air void 13 may be trapped between the filling material applied to the water-repellent layer and the depressed portion, and the air void 13 may inhibit filling of the depressed portion with the filling material. Trapping of the air void 13 between the filling material and the depressed portion may be suppressed by depositing the same substance as the material of the filling member on edge portions 15 of the depressed portion. This suppresses the formation of a meniscus 16 formed when the filling material traps the air void and thus allows the trapping of the air void 13 to be suppressed and the depressed portion to be filled with filling material. The same substance as the material of the filling member may be deposited on the edge portions 15 of the depressed portion by, for example, depositing the filling material on the surface of the orifice plate including the water-repellent layer in the form of fine particles by a spray method or the like. Then, the filling material can be applied by spin-coating.

Figure 4B:
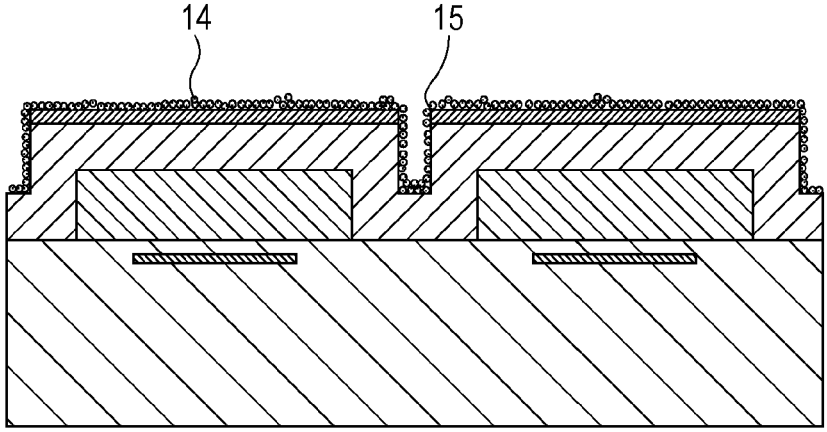
Figure 4C:
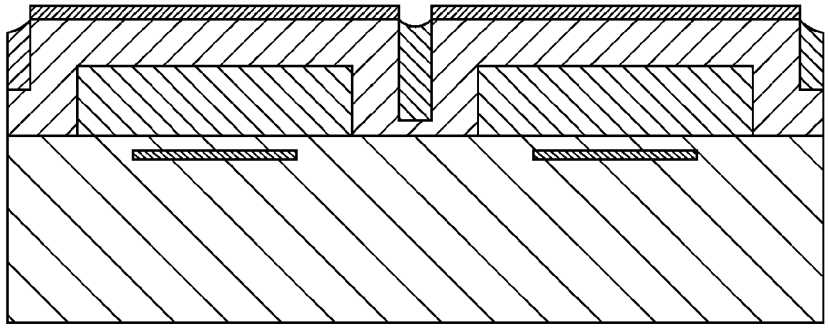

A widely used method for depositing the filling material in the form of fine particles is spray coating. Spray coating is a technique for forming a film by spraying a liquid substance to be applied against a target as fine particles 14 with micron order size. This filling material, which is formed into fine particles by spray coating, can be deposited on the edge portions of the depressed portion and in the depressed portion without trapping the air void even when the width of the depressed portion is small as shown in FIG. 4B. When spray coating is performed, the fine particles 14 may be disadvantageously deposited also on the water-repellent layer, on which the filling member is not to be formed. Therefore, after performing spray coating, the filling material is deposited over the entire surface of the substrate including the depressed portions by spin-coating. This allows the filling material deposited on the water-repellent layer to flow into the depressed portions as shown in FIG. 4C.

EXAMPLES

In Examples, the method of producing the liquid-ejection head according to the present disclosure will be described further in detail with reference to FIGS. 1A to 1G illustrating the steps of the method.

As shown in FIG. 1A, a liquid-ejection-head substrate 1 was prepared by forming actuators 2 and wiring lines (not shown) to drive the actuators 2 on one surface of a single-crystal silicon substrate having a thickness of 300 μm produced by drawing an ingot in the <100> direction.

As shown in FIG. 1B, molds 3 serving as mold members were formed of a material capable of being removed in the post-process so that a liquid chamber was formed at the position corresponding to each actuator. The mold material was a polyimide resin (Product name: PI2611, produced by HD MicroSystems, Ltd.). This mold material was applied to the substrate by spin-coating and heated using an oven to cause dehydration condensation. Subsequently, a positive photosensitive photoresist was applied to the mold material and patterned into a desired shape. The polyimide resin was patterned by RIE using an oxygen-based gas. Then, the photoresist mask was removed. Thus, the molds 3 were formed.

As shown in FIG. 1C, a flow-passage-forming member 17 was formed on the substrate 1 and the mold 3 by depositing an inorganic material by PECVD. The inorganic material was SiN. As a result, members that were to be formed into an orifice plate 4 and a liquid-chamber side wall 5 were formed of SiN, and depressed portions 6 were formed in areas in which the mold was not formed.

As shown in FIG. 1D, a water-repellent layer 7 was formed only on the surface of the orifice plate. The water-repellent material was a fluorocarbon compound (product name: OPTOOL, produced by DAIKIN INDUSTRIES, LTD) diluted with perfluorohexane to a concentration of 0.1% by mass. The water-repellent material was applied only to the surface of the orifice plate using a roller impregnated with this water-repellent material by moving the roller along the surface of the orifice plate. Subsequently, the substrate was left still for 3 hours in a thermostat kept at 60° C. and at a humidity of 90% to dry the water-repellent material. Thus, the water-repellent layer 7 was formed.

As shown in FIG. 1E, the filling material was applied to the flow-passage-forming member including the depressed portions 6 to fill the depressed portions with the filling material. The filling material was a mixture prepared by adding glycerin to organic SOG (Product name: ACCUGLASS T-12B, produced by Honeywell International Inc.) containing a methylsiloxane polymer as a main component until the concentration of glycerin reached 7% by weight and stirring the mixture sufficiently. This filling material was applied to the flow-passage-forming member by spin-coating. Due to the effect of the water-repellent layer formed on the surface of the orifice plate, the filling material flowed into the depressed portions 6, and thereby the depressed portions were filled with the filling material. Subsequently, the substrate was baked using a hot plate at 80° C. and at 120° C. gradually, and then heat-treated in an oven kept at 400° C. in a $N_2$ environment to volatilize the solvent and to cause the organic SOG to initiate polymerization. Thus, the filling members 8 were formed in the depressed portions.

As shown in FIG. 1F, ejection ports 9 that eject a liquid were formed in the flow-passage-forming member. The ejection ports were formed as follows. Photoresist was applied to the orifice plate and the filling members, and a portion of the photoresist mask in which the ejection ports were to be formed was patterned to form a mask 10. A portion of the orifice plate composed of SiN was removed by RIE using a fluorine-based gas, and then the mask 10 was removed.

Subsequently, a protective layer that protects the orifice plate was formed, and liquid supply ports through which a liquid is supplied to the liquid chambers or the liquid-flow passages was formed from a side of the substrate on which the orifice plate was not formed (not shown).

As shown in FIG. 1G, the mold composed of a polyimide resin was removed by CDE using an oxygen-based gas to form the liquid chambers 11.

In the liquid-ejection head 20 prepared as described above, although the depressed portions were formed in the orifice plate composed of the inorganic material, the depressed portions were able to be filled with the filling members at low cost.

The liquid-ejection head was evaluated in terms of printing quality. It was found that degradation of printing quality was suppressed because liquid pools due to mist generated when a liquid is ejected were not formed in the depressed portions since the depressed portions were filled with the filling members. It was also found that, when the orifice plate was wiped by a blade, efficient wiping was performed since the depressed portions were filled with the filling members, and thus printing quality was properly recovered.

The present invention may be applied to a recording head of an ink jet printer.

According to the present disclosure, a method for producing a liquid-ejection head with which the depressed portions formed in the flow-passage-forming member may be efficiently filled when the flow-passage-forming member was formed by CVD using an inorganic material is provided.

According to the present disclosure, a method for easily producing a liquid-ejection head including a flow-passage-forming member formed of an inorganic material by CVD with which depressed portions may be efficiency filled, formation of liquid pools may be suppressed, and degradation of printing quality may be suppressed is provided.

Specifically, according to the present disclosure, a liquid-ejection head that allows depressed portions formed due to the nature of CVD to be efficiently filled with filling members, that allows formation of a liquid pool in the depressed portion to be suppressed, and that allows degradation of printing quality to be suppressed may be produced at low cost.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-220367 filed Oct. 2, 2012, which is hereby incorporated by reference herein in its entirety.

What is claimed is:

1. A method for producing a liquid-ejection head including:

a substrate on or above which a plurality of actuators are formed, the plurality of actuators generating energy for ejecting a liquid; and a flow-passage-forming member on or above the substrate, the flow-passage-forming member defining ejection ports through which the liquid is ejected and a plurality of liquid chambers each having a corresponding one of the plurality of actuators, the flow-passage-forming member including an orifice plate defining the ejection ports and liquid-chamber side walls defining side walls of the plurality of liquid chambers, the method comprising the steps of:

(1) forming molds on or above the substrate;

(2) forming the flow-passage-forming member by depositing an inorganic material on or above the substrate and the molds by chemical vapor deposition, the flow-passage-forming member having depressed portions each formed in an area between an adjacent pair of the liquid-chamber side walls in which the molds are not formed;

(3) forming a water-repellent layer on the orifice plate;

(4) forming filling members in the depressed portions by applying a filling material to the flow-passage-forming member having the water-repellent layer formed thereon to fill the depressed portions with the filling material;

(5) forming the ejection ports in the flow-passage-forming member; and (6) forming the plurality of chambers by removing the molds after forming the ejection ports.

2. The method for producing a liquid-ejection head according to claim 1, wherein, in the step (3), the water-repellent layer is not formed in the depressed portions.

3. The method for producing a liquid-ejection head according to claim 1, wherein, in the step (4), the filling material is applied to the flow-passage-forming member by spin-coating.

4. The method for producing a liquid-ejection head according to claim 1, wherein, in the step (4), after the depressed portions are filled with the filling material, the filling material is solidified to form the filling members.

5. The method for producing a liquid-ejection head according to claim 1, wherein the filling material contains a methylsiloxane polymer.

6. The method for producing a liquid-ejection head according to claim 1, wherein the filling material contains at least one solvent component selected from water, ethylene glycol, and glycerin.

7. The method for producing a liquid-ejection head according to claim 1, further comprising between the steps (3) and (4), a step of depositing the filling material on the flow-passage-forming member in the form of fine particles.

8. A method for producing a liquid-ejection head including:

a substrate; and a flow-passage-forming member defining a plurality of ejection ports through which a liquid is ejected and a plurality of liquid chambers serving as flow passages through which the liquid flows, the method comprising the steps of:

forming molds on or above the substrate;

forming a member composed of an inorganic material on or above the substrate by depositing the inorganic material on the molds by chemical vapor deposition, the member having depressed portions each formed between an adjacent pair of the plurality of molds;

depositing a water-repellent material on a surface of the member composed of the inorganic material, the surface being on the side opposite to the substrate;

filling the depressed portions with a filling material by applying the filling material to a surface of the member composed of the inorganic material on or above which the water-repellent material is deposited;

forming the plurality of ejection ports in the surface of the member composed of the inorganic material on or above which the water-repellent material is deposited; and forming the plurality of chambers by removing the molds after forming the plurality of ejection ports.

9. The method for producing a liquid-ejection head according to claim 8, wherein, in the step of depositing the water-repellent material, the water-repellent material is not deposited in the depressed portions.

10. The method for producing a liquid-ejection head according to claim 8, wherein, in the step of filling the depressed portions with the filling material, the filling material is applied to a surface of the member composed of the inorganic material by spin-coating, the surface on or above which the water-repellent material is deposited.

11. The method for producing a liquid-ejection head according to claim 8, wherein, in the step of filling the depressed portions with the filling material, after the depressed portions are filled with the filling material, the filling material is solidified.

12. The method for producing a liquid-ejection head according to claim 8, wherein the filling material contains a methylsiloxane polymer.

13. The method for producing a liquid-ejection head according to claim 8, wherein the filling material contains at least one solvent component selected from water, ethylene glycol, and glycerin.

14. The method for producing a liquid-ejection head according to claim 8, further comprising, between the step of depositing the water-repellent material and the step of filling the depressed portions with the filling material, a step of depositing the filling material on the surface of the member composed of the inorganic material in the form of fine particles, the surface on or above which the water-repellent material is deposited.

* * * * *